US011208852B2

(12) United States Patent
Heckl

(10) Patent No.: US 11,208,852 B2
(45) Date of Patent: Dec. 28, 2021

(54) AUGER ARRANGEMENT

(71) Applicant: BAUER Spezialtiefbau GmbH, Schrobenhausen (DE)

(72) Inventor: Konrad Heckl, Pöttmes (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 16/758,322

(22) PCT Filed: Sep. 20, 2018

(86) PCT No.: PCT/EP2018/075460
§ 371 (c)(1),
(2) Date: Apr. 22, 2020

(87) PCT Pub. No.: WO2019/086164
PCT Pub. Date: May 9, 2019

(65) Prior Publication Data

US 2020/0318441 A1 Oct. 8, 2020

(30) Foreign Application Priority Data

Nov. 2, 2017 (EP) ..... 17199636

(51) Int. Cl.
*E21B 17/046* (2006.01)
*E21B 17/22* (2006.01)
*E02D 5/22* (2006.01)

(52) U.S. Cl.
CPC ..... *E21B 17/0465* (2020.05); *E21B 17/22* (2013.01); *E02D 5/22* (2013.01)

(58) Field of Classification Search
CPC .... E21B 17/0465; E21B 17/22; E21B 17/046; E21B 10/44; E21B 7/005; E21B 17/04;
(Continued)

(56) References Cited

U.S. PATENT DOCUMENTS 2,088,759 A * 8/1937 Rassieur ..... E21B 17/22 175/323
2,141,880 A * 12/1938 Satre ..... E21B 17/046 175/320

(Continued)

FOREIGN PATENT DOCUMENTS

DE 28 56 1 26 C2 7/1986
DE 19527990 C1 8/1996

(Continued)

OTHER PUBLICATIONS

International Preliminary Report on Patentability and Written Opinion issued in PCT/EP2018/075460; dated May 5, 2020.

(Continued)

*Primary Examiner* — David Carroll
(74) *Attorney, Agent, or Firm* — Studebaker & Brackett PC

(57) ABSTRACT

The invention relates to an auger arrangement and a method for forming an auger arrangement having a first drill part and a second drill part which are of tubular or bar-shaped design and in which at least one drill part is provided on its external side with an auger flight, wherein on at least one of their end regions the drill parts have matching connecting sections, wherein a first connecting section is designed as a sleeve-like female part with keyway elements and a second connecting section is designed as a mandrel-like male part with keyway elements, wherein male part and female part are plugged axially into each other to form a releasable, torque-proof connection. According to the invention provision is made in that on an internal wall of the female part an annular internal groove is applied, in that on an external wall of the male part an annular external groove is applied, in that in a plugged-together state of female part and male part the internal groove and the external groove lie opposite each other and form an annular space, on an external wall of the (Continued)

Figure 1:
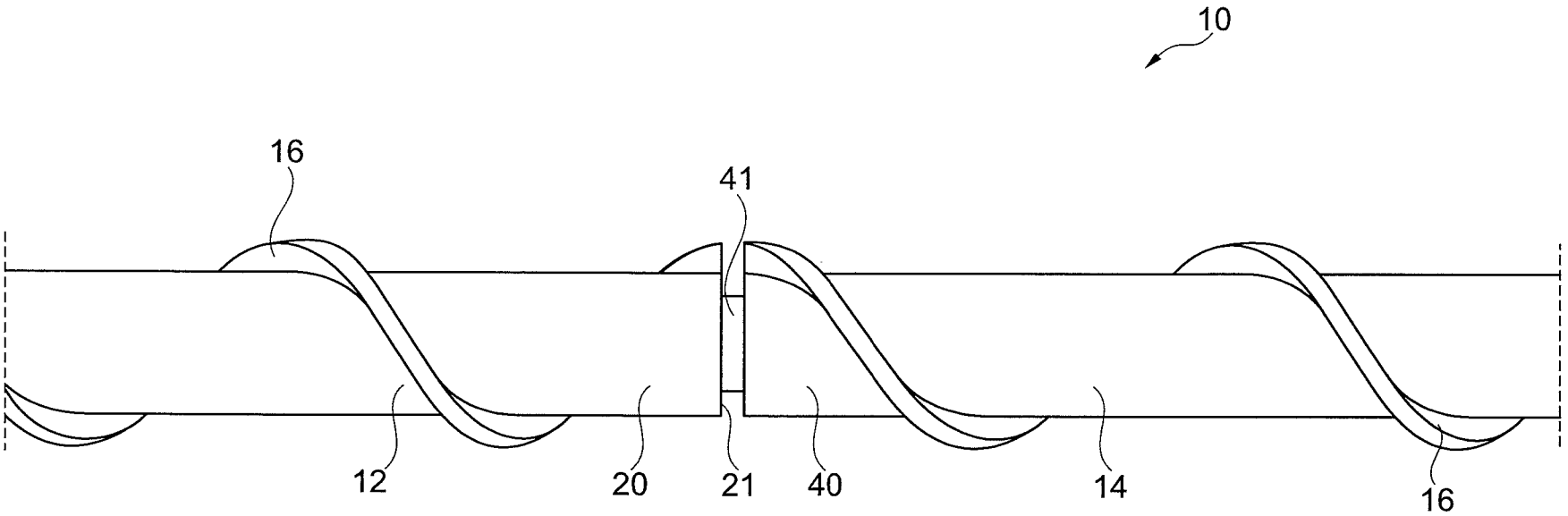

female part at least one introduction opening with a passage to the annular internal groove is designed and in that in order to form an axial securing a flexible steel cable is inserted via the introduction opening into the annular space and fills this out completely or to a large degree.

9 Claims, 5 Drawing Sheets

(58) Field of Classification Search
CPC ..... E21B 17/041; E21B 17/05; E21B 17/06; E21B 37/14; E21B 37/142; E21B 37/148
See application file for complete search history.

(56) References Cited

U.S. PATENT DOCUMENTS 2,588,901 A * 3/1952 Weikart ..... E21B 10/44 403/292
3,077,235 A * 2/1963 Govin ..... E21B 10/32 175/285
3,664,444 A * 5/1972 Henson ..... E21B 17/046 198/666
3,848,683 A * 11/1974 Persson ..... E21B 10/40 175/65
4,697,947 A * 10/1987 Bauer ..... E21B 17/046 403/14
4,821,818 A * 4/1989 Mefferd ..... E21B 17/046 175/323
4,880,122 A * 11/1989 Martindell ..... B25H 3/003 211/70.6
5,383,694 A 1/1995 Taeuber, Jr. et al.
7,559,583 B2 * 7/2009 Stoetzer ..... E21B 17/046 285/403

FOREIGN PATENT DOCUMENTS

DE 10 2006 022 613 B4 8/2008
EP 0204128 A2 12/1986
EP 0438296 A2 7/1991
EP 2 487 320 B1 10/2013
GB 570671 A 7/1945
GB 2276217 A 9/1994

OTHER PUBLICATIONS

International Search Report issued in PCT/EP2018/075460; dated Jan. 18, 2019.

* cited by examiner

AUGER ARRANGEMENT

The invention relates to an auger arrangement having a first drill part and a second drill part which are of tubular or bar-shaped design and in which at least one drill part is provided on its external side with an auger flight, wherein on at least one of their end regions the drill parts have matching connecting sections, wherein a first connecting section is designed as a sleeve-like female part with keyway elements and a second connecting section is designed as a mandrel-like male part with keyway elements, wherein male part and female part are plugged axially into each other to form a releasable, torque-proof connection, in accordance with the preamble of claim 1.

Such an auger arrangement is used, in particular, for forming so-called continuous flight augers that are especially employed for producing piles in the ground. For this, the auger must have a length that corresponds at least to the depth of the bore to be produced in the ground. On its external side the auger has one or several continuous auger flights that serve to convey away the ground material out of the borehole.

According to the required length it is often necessary to compose the auger arrangement of several drill parts. The individual drill parts typically have a length of several meters. On their end faces the drill parts are provided with connecting sections, with which these can be plugged into each other and connected.

An auger arrangement can be taken from DE 10 2006 022 613 B4 for example. In a plugged-together state the auger parts can be secured axially by means of conical bolts that have a screw thread by screwing the conical bolts from the outside radially inwards. Furthermore, it is also known from this document that rod-shaped, slightly curved clamping brackets are inserted tangentially into a corresponding latch recess so that the plugged-together drill parts are secured axially. Due to their curvature the clamping brackets retain in a force-locking manner in the latch recess. The release of such clamping brackets from a latch bore can be problematic.

From DE 195 27 990 C1 a drill rod arrangement is known, in which provision is made on a mandrel-like connecting section of a drill rod element for a radially directed and spring-supported snap-lock pin. On insertion of this mandrel-like male part into a sleeve-like female part of a further drill rod element to be attached the snap-lock pin is initially pressed back in order to then lock radially outwards into a locking bore. From this printed publication the use of a U-shaped clamping bracket can furthermore be taken which can also be inserted tangentially into latch recesses.

A rotary drill rod having a connecting means with another snap-lock pin can also be taken from DE 28 56 126 C2.

An auger of modular construction is furthermore known from EP 2 487 320 B1. On a drill bit a central receiving shaft is provided, onto which several flight plate sections can be mounted. The flight plate sections are screwed along the abutting edges of the flight plates.

A generic auger arrangement is known from GB 2 276 217 A. In this arrangement stabilizing suspension located in the borehole can enter into the region of the external keyway elements.

A plug connection for drill pipes can be taken from EP 0 204 128 A2, in which case the keyway elements are located internally.

EP 0 438 296 A2 discloses a sleeve-shaped connecting member for pipe elements to be connected.

The invention is based on the object to provide an auger arrangement, which allows for an easy and at the same time stable and tight connection of several drill parts to form the auger arrangement.

In accordance with the invention the object is achieved on the one hand by an auger arrangement having the features of claim 1. Preferred embodiments of the invention are stated in the dependent claims.

In the auger arrangement according to the invention provision is made in that on an internal wall of the female part an annular internal groove is applied, in that on an external wall of the male part an annular external groove is applied, in that in a plugged-together state of female part and male part the internal groove and the external groove lie opposite each other and form an annular space, in that on an external wall of the female part at least one introduction opening with a passage to the annular internal groove is designed and in that in order to form an axial securing a flexible steel cable is inserted via the introduction opening into the annular space and fills this out completely or to a large degree.

A basic idea of the invention resides in the fact that for the connection of drill parts of an auger arrangement, of which at least one drill part has an external auger flight, corresponding connecting sections are provided with a sleeve-shaped female part and a mandrel-like male part. Here, on an internal wall of the female part an annular internal groove is arranged and on an external wall of the mandrel-like male part an annular external groove is arranged such that in a plugged-together state these lie opposite each other. In this plugged-together state a torque-proof connection is realized in that corresponding keyway elements on the female part and the male part inter-engage in the circumferential direction for the torque transmission.

To axially secure the connection in the plugged-together state provision is made on the female part for an introduction opening with a passage to the annular internal groove. Via this introduction opening a flexible steel cable can be inserted into the joint annular space formed by the internal groove and the external groove in the plugged-together state. Due to its flexibility the steel cable can follow the curved annular space and can be inserted into it in such a manner that the annular space is filled out completely or to a large degree. The steel cable thus constitutes an axial locking element. The external diameter of the steel cable and the internal diameter of the annular space form a clearance fit.

The joint annular space and the steel cable are preferably circular in cross-section.

Accordingly, the internal groove and the external groove each have a semi-circular cross-section. Other cross-sections, for instance angular ones, are basically possible.

A steel cable as locking element is very cost-efficient and stable. On account of its flexibility it can be inserted easily into an annular space, whereby such a form-fitting locking is practically achieved over the entire circumference of the tubular connecting section. Overall, a steel cable is also very robust and less prone to wear.

A preferred embodiment of the invention resides in the fact that several external grooves and several internal grooves are provided which form several annular spaces in the plugged-together state. In this way, a multiple locking can be achieved. By preference, two, three or more annular spaces are arranged parallel to each other on a connecting section. Basically, the formed annular spaces are closed in the circumferential direction. However, the annular spaces can also have a certain helical shape, in which case a multiple winding and a multiple locking could thus be realized with a single steel cable.

Basically, the grooves can be arranged at arbitrary positions of the connecting sections. From the viewpoint of wear it is particularly expedient that on a connecting section the internal grooves and the external grooves lie behind the keyway elements in a plug-in direction. This preferably applies to the internal male part, while the arrangement on the external female part is correspondingly vice versa. Hence, the keyway elements lie closer to the free end of the respective connecting section. By way of the keyway elements an initial mechanical connection and guidance can thus be achieved when plugging together.

Another advantageous embodiment of the invention can be seen in the fact that on at least one connecting section a sealing region is arranged. By preference, on both opposite connecting sections sealing regions are provided that correspond with each other so that a sealing is realized in the region of the connection. This is especially advantageous if the auger arrangement is as a whole of tubular shape with an internal hollow space that is provided e.g. for the passage of drilling suspension, compressed air or concrete.

According to a further development of the invention it is especially advantageous that the sealing region has at least one sealing ring. For this, provision can preferably be made in one of the sealing regions for an annular groove to receive a sealing ring, in particular an O-sealing ring. The corresponding surrounding sealing region can have a smooth sealing surface, against which the sealing ring comes to rest in a sealing manner.

A particularly expedient embodiment variant of the invention resides in the fact that the keyway elements lie between the sealing region and the internal grooves or the external grooves. By arranging the sealing region in a front region a hardenable liquid can in particular be prevented from entering into the intermediate space between the connecting elements and polluting the keyway elements or the internal and external grooves in particular.

The steel cable can preferably be an elastically flexible wire consisting of a uniform material or a braided cable with several steel cable fibers. By steel cable a cable is to be understood in particular which is formed of ferrous steel or a corresponding stable metal or a material of comparable strength and flexibility. It is especially preferred that on the flexible steel cable on a section a stop element is attached. The stop element renders it is possible that for the purpose of releasing the connection the steel cable can be pulled easily out of the joint annular space again.

In this connection, it is particularly advantageous that the stop element can be received in the introduction opening. The introduction opening has a dimensioning which allows the stop element to be received completely or at least partly in the introduction opening. Preferably, the stop element does not protrude from the introduction opening so that during a drilling operation it is exposed to no or only little wear due to the ground material brushing past. Additionally or alternatively, the introduction opening can be covered by a clamp or the like. At the same time, however, the stop element is dimensioned larger than the passage to the annular space so that the steel cable can only be introduced up to the stop element into the annular space. This permits a safe gripping and release of the steel cable from the annular space.

According to a further embodiment variant pursuant to the invention a particularly good handling is achieved in that the introduction opening is designed as an elongated hole that extends along a part of the annular space and in that the stop element has a length that is smaller than the length of the elongated hole of the introduction opening.

For an easiest possible insertion of the steel cable into the annular space it is advantageous that the flexible steel cable has an introduction tip on a front end. The introduction tip can be designed directly on the steel cable or formed by placing a corresponding part of conical shape.

Another preferred embodiment of the invention can be seen in the fact that the stop element is arranged spaced apart from a rear end of the flexible steel cable, wherein a stand-alone latch section of the steel cable is formed which serves for the bilateral insertion of the steel cable into the annular space. Here, the stand-alone latch section and the length of the stop element are designed such that they can preferably be introduced completely into the introduction opening, more particularly an elongated hole, in a first direction of insertion. Subsequently, the steel cable can be displaced inside the annular space with the stop element in the opposite direction, in which case the stand-alone latch section is also received in the formed annular space. Hence, the stop element is secured on both sides by sections of the steel cable in the annular space, whereby a good positional securing is provided.

The method according to the invention is characterized in that a first drill part and a second drill part are plugged axially into each other, which at least have a female part or a male part, in that in the plugged-together state a joint annular space is formed by an annular internal groove on an internal wall of the female part and by an annular external groove on an external wall of the male part, in that via an introduction opening on an external wall of the female part a flexible steel cable is inserted via a passage, which steel cable fills out the annular space completely or to a large degree, wherein an axial securing is formed between the first drill part and the second drill part.

The method according to the invention is provided to form an auger arrangement that has been described previously. The advantages described beforehand can be achieved thereby.

Figure 2:
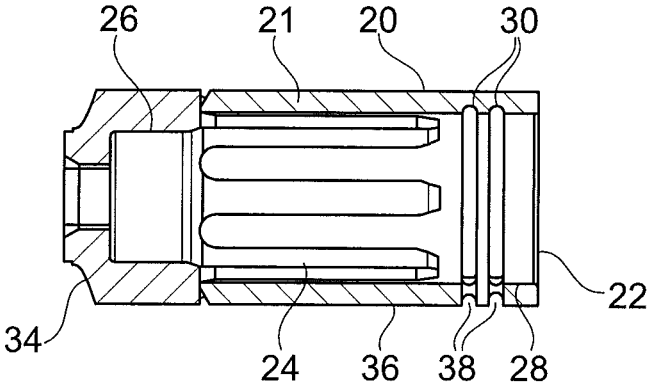
Figure 3:
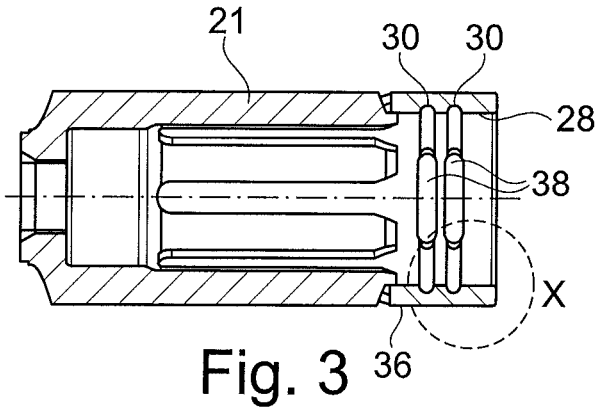
Figure 4:
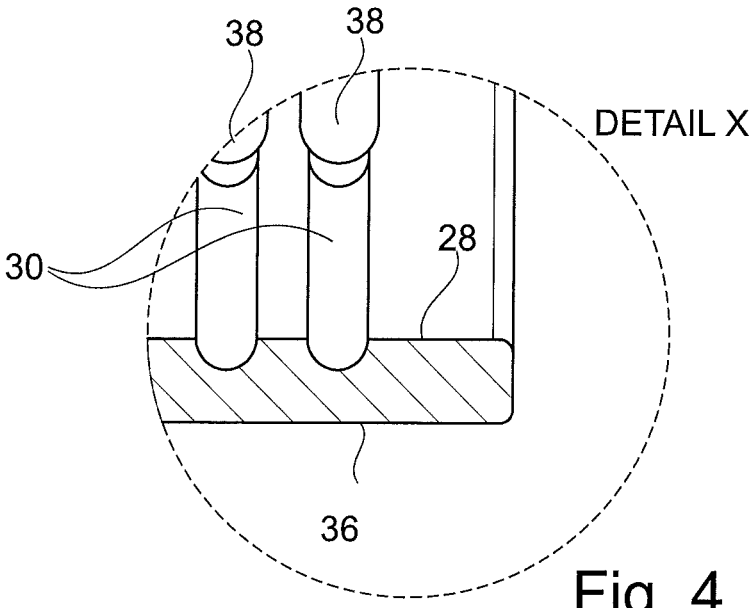
Figure 5:
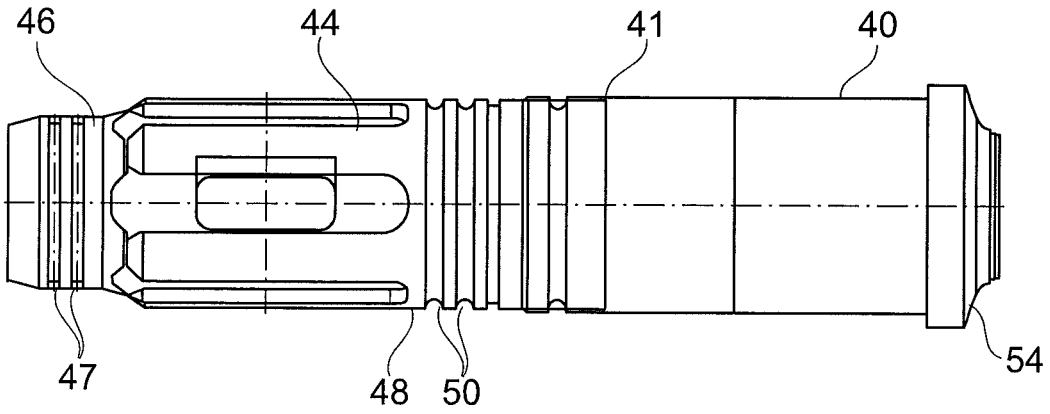
Figure 6:
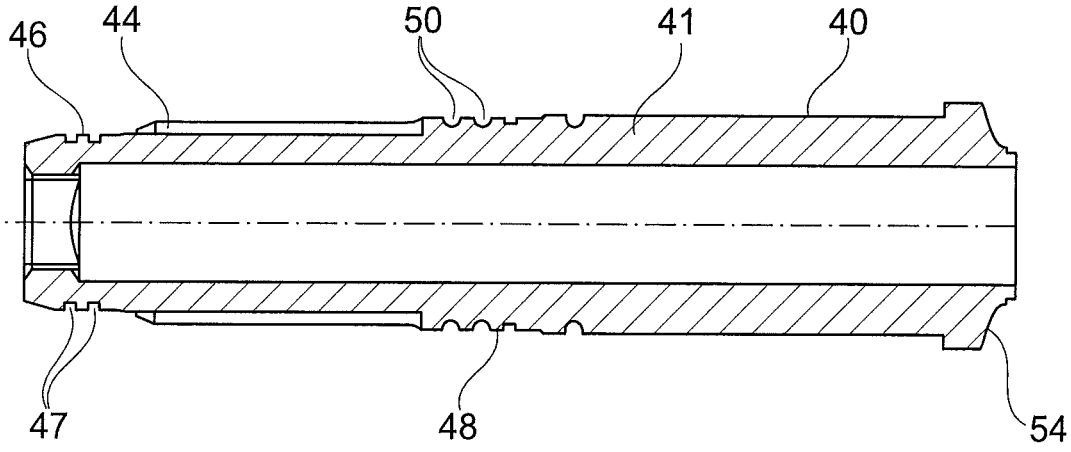
Figure 7:
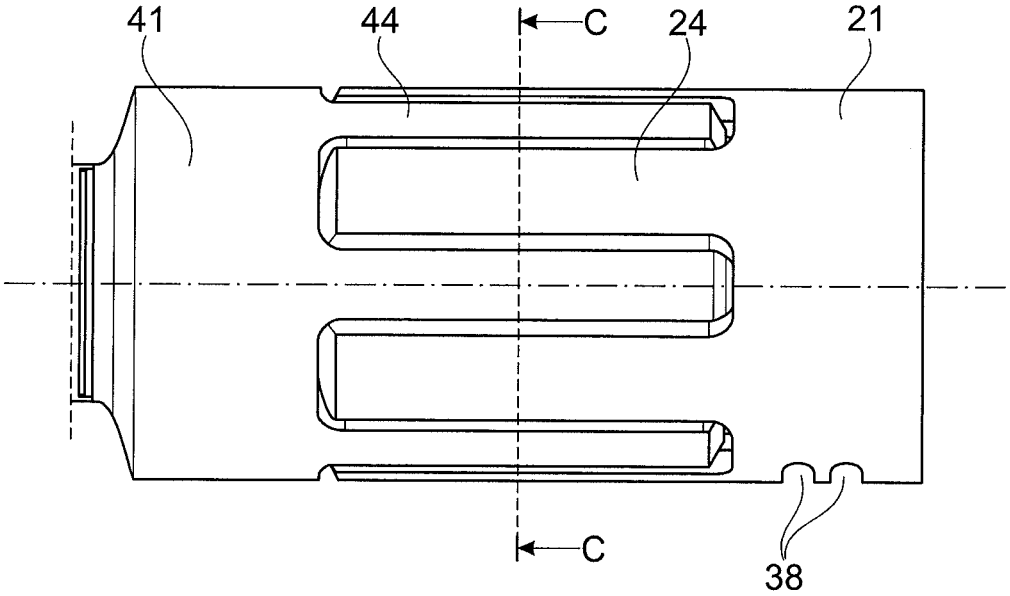
Figure 8:
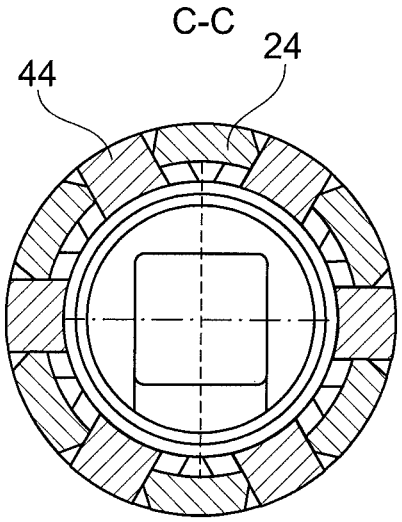
Figure 9:
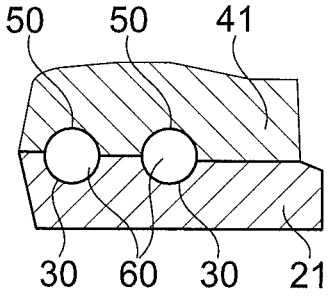
Figure 10:
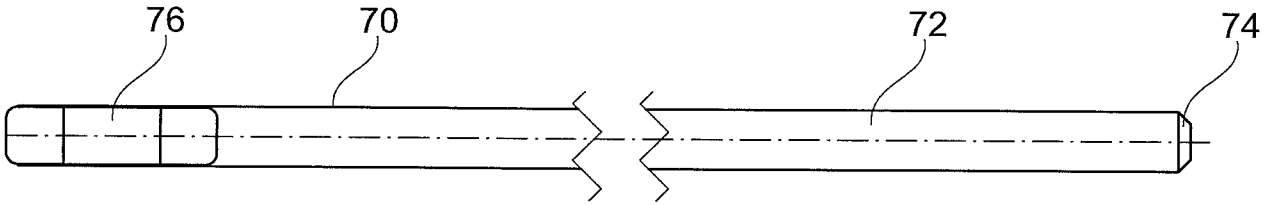
Figure 11:
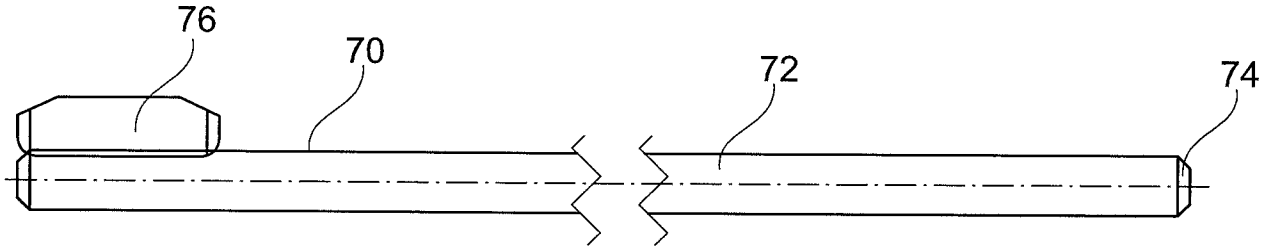

The invention is described further hereinafter by way of preferred exemplary embodiments illustrated schematically in the drawings, wherein show:

FIG. 1 a schematic partial view of an auger arrangement according to the invention when being plugged together;

FIG. 2 a partial cross-sectional view of a female part on a drill part;

FIG. 3 a further cross-sectional view of the female part of FIG. 2 with the direction of section rotated by 90°;

FIG. 4 an enlarged detailed view of internal grooves on the female part according to FIG. 3;

FIG. 5 a side view of a matching male part of a drill part for the auger arrangement according to the invention;

FIG. 6 a cross-sectional view of the male part of FIG. 5;

FIG. 7 a partial view of male part and female part in a plugged-together state;

FIG. 8 a cross-sectional view according to section C-C of FIG. 7;

FIG. 9 a detailed cross-sectional view concerning annular spaces formed in a plugged-together state;

FIG. 10 a top view of a steel cable according to the invention;

FIG. 11 a side view of the steel cable of FIG. 10; and

Figure 12:
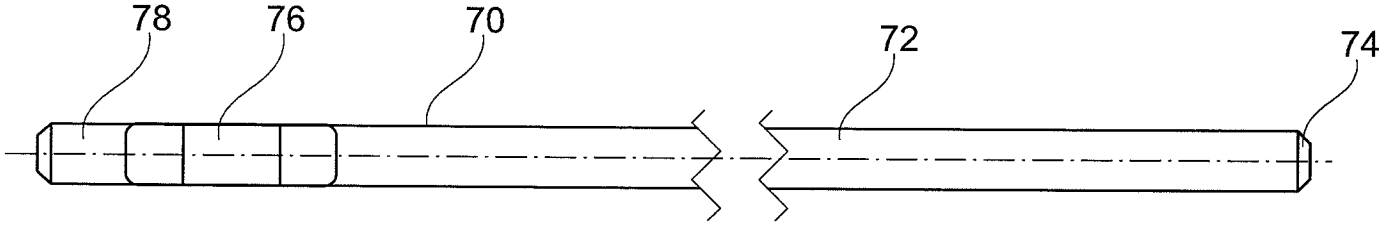

FIG. 12 a top view of a modified steel cable according to the invention.

An auger arrangement 10 according to the invention is shown schematically in FIG. 1 when plugging together a first drill part 12 and a second drill part 14. On one end the first drill part 12 has a first connecting section 20 that is designed as a female part 21 with a receiving space. Into this female part 21 a mandrel-like male part 41 can be inserted that is designed on a second connecting section 40 on the adjoining second drill part 14. On the first drill part 12 and the second drill part 14 an auger flight 16 for conveying drilled ground material is arranged in each case. The auger illustrated in FIG. 1 is right-handed but can also be of left-handed design.

The auger arrangement 10 according to the invention serves, in particular, for producing bores in the ground, e.g. for the production of ground piles for foundations for example. The auger arrangement 10 can be constructed of a plurality of drill parts which are connected to each other, as described in the following. On the lower end of the auger arrangement 10 a ground-removing tool is usually located, whereas on the other, upper end a connection to a rotary drill drive and, as the case may be, a fluid connection for supplying a fluid, such as drilling suspension or a hardenable mass, in the interior of the auger arrangement 10 are arranged.

In the following the construction of a female part 21 for the auger arrangement 10 according to the invention is described in conjunction with FIGS. 2 to 4. In FIGS. 2 to 4 the first connecting section 20 with the female part 21 is in each case illustrated without the tubular base body and the auger flight. The female part 21 is of sleeve-shaped design with an open end 22, into which the male part 41 can be inserted. To establish a torque-proof connection, first keyway elements 24 are designed in a center region of the receiving space of the female part 21. Between the first keyway elements 24 and the open end 22 two internal grooves 30 with a semi-circular groove cross-section are incorporated into an internal wall 28. On an external wall 36 of the female part 21 two introduction openings 38 are designed as elongated holes, as depicted graphically in FIG. 3. The introduction openings 38 are each connected via a passage to one of the grooves 30. Through the introduction openings 38 a steel cable can be inserted to form an axial securing, as described in greater detail hereinafter.

On the end of the first connecting section 20 lying opposite the open end 22 a first fixing section 34 is designed, to which the tubular base body can be attached, more particularly welded, to form the first drill part 12. Between the first fixing section 34 and the first keyways 24 a first sealing region 26 with a cylindrical internal wall is arranged. This first sealing region 26 serves to receive a corresponding sealing region that is designed on the related male part 41, as described in greater detail hereinafter. The first connecting section 20 with the female part 21 can be designed in one piece or as a multi-part welded part, as illustrated in the alternative embodiment variants according to FIGS. 2 and 3.

In FIGS. 5 and 6 a matching second connecting section 40 with a male part 41 is illustrated which can be plugged into the female part 21 according to FIGS. 2 to 4.

On its front end the mandrel-like and tubular male part 41 has a second sealing region 46 with grooves 47 to receive sealing rings. The second sealing region 46 is designed such that in the plugged-in state it forms a fluid-tight sealing with the first sealing region 26 on the female part 21.

Following the second sealing region 46 second keyway elements 44 are designed on an external side of the male part 41. These correspond to the first keyway elements 24 on the female part 21 so that they can be plugged axially into each other to form a torque-transmitting connecting region, as depicted in FIG. 7.

In a subsequent external wall 48 of the male part 41 two external grooves 50 are applied. In a plugged-together state of male part 41 and female part 21 the external grooves 50 designed with a semi-circular cross-section lie opposite the internal grooves 30 on the female part 21 so that a joint annular space 60 with circular cross-section is formed. This is illustrated graphically in FIG. 9.

On a rear end of the male part 41 a second fixing section 54 is designed that serves to attach the further tubular body of the second drill part 14. For a modular construction each drill part 12, 14 can have a first connecting section 20 and a second connecting section 40 at opposite ends.

An interaction of the first and second keyway elements 24, 44 is depicted graphically in FIGS. 7 and 8. The first keyway elements 24 on the female part 21 and the second keyway elements 44 on the male part 41 are designed to correspond in their length and width so that they can be plugged axially into each other. The flanks of the keyway elements 24, 44 rest against each other and can serve for the torque transmission between female part 21 and male part 41. In FIG. 7 the two introduction openings 38 on the female part 21 are in addition indicated schematically.

The FIGS. 1 to 9 show the subject matter of the invention on a reduced scale, whereas in the ensuing FIGS. 10 to 12 a steel cable 70 provided for the invention is illustrated on a different, larger scale. The FIGS. 10 and 11 show a first steel cable 70 according to the invention with a cable base body 72. On one end of the cable base body 72 an introduction tip 74 is designed which serves for the introduction of the steel cable 70 via the introduction opening 38 in the female part 21 into the formed annular space 60. The flexible steel cable 70 preferably has a circular cross-section, the external diameter of which forms a clearance play with respect to the internal diameter of the annular space 60. The introduced steel cable 70 constitutes a form-fitting body which axially secures the drill parts 12, 14 plugged into each other in their position.

On the other end lying opposite the introduction tip 74 a block-like stop element 76 is fixed on the cable base body 72, preferably through brazing or welding. The block-like stop element 76 has a dimensioning that makes it possible to place the stop element 76 into the introduction opening 38 on the female part 21, while a further insertion into the annular space 60 is prevented.

An alternative embodiment of the steel cable 70 is shown in FIG. 12. This steel cable 70 also has a cable base body of a metallic flexible material as well as an introduction tip 74 and a block-like stop element 76 just as in the embodiment according to the FIGS. 10 and 11. In contrast to the first embodiment variant the block-like stop element 76 is spaced apart from the rear end so that a latch section 78 is designed. Taken together, the length of the latch section 78 and the length of the stop element 76 are here smaller than the length of the introduction opening 38 on the female part 21. This makes it possible that the steel cable 70 can initially be inserted with the introduction tip 74 in one introduction direction into the annular space 60 until the stop element 76 abuts on one end of the introduction opening 38 on the female part 21. In this abutment situation the latch section 78 is also received in the introduction opening 38. The cable 70 can now be displaced in the opposite direction into the annular space 60 so that the latch section 78 is introduced into the annular space 60. In this way, the steel cable 70 is received with both end regions in the annular space 60 so that the steel cable 70 is received and locked in a particularly reliable manner in the annular space 60.

The invention claimed is:

1. An auger arrangement comprising a first drill part, a second drill part and a connection, the first and second drill parts comprising a tubular or a bar and in which at least one drill part comprises an auger flight on an external surface of the at least one drill part, wherein the first drill part comprises a first connection section and the second drill part comprises a second connection section; wherein the first and second connection sections configured to mate with each other to form the connection, wherein the first connecting section comprises a female sleeve part, the female sleeve part comprising keyway elements, an internal wall, the internal wall comprising a plurality of annular internal grooves located on the internal wall, an external wall, the external wall comprising at least one introduction opening with a passage to the annular internal groove;

wherein the second connecting section comprises a male mandrel part, the male mandrel part comprising keyway elements, a front region, an external wall, and a plurality of annular external grooves located on the external wall;

wherein the male mandrel part is configured to axially plug into the female sleeve part and form a releasable, torque-proof connection;

wherein the annular external grooves located on the external wall of the male mandrel part and the annular internal grooves located on the internal wall of the female sleeve part are configured to lie opposite each other and form a plurality of annular spaces when the male mandrel part and the female sleeve part are in a plugged-together state;

the connection further comprising an axial securing flexible steel cable configured to be inserted via the introduction opening into at least one annular space, the axial securing flexible steel cable configured to completely fill the annular space;

wherein at least one of the first or second connecting section comprises a sealing region, the sealing region on the male mandrel part is located in the front region;

wherein the keyway elements lie between the sealing region and the annular internal grooves on the internal wall of the female sleeve part or the annular external grooves on the external wall of the male mandrel part;

wherein on the flexible steel cable on an end section a stop element is attached;

wherein the stop element is arranged spaced apart from a rear end of the flexible steel cable, and wherein a stand-alone latch section of the steel cable is formed which serves for the bilateral insertion of the steel cable into the annular space.

2. The auger arrangement according to claim 1, wherein on a connecting section the internal grooves and the external grooves lie behind the keyway elements in a plug-in direction.

3. The auger arrangement according to claim 1, wherein the sealing region has at least one sealing ring.

4. The auger arrangement according to claim 1, wherein the stop element can be received in the introduction opening.

5. The auger arrangement according to claim 1, wherein the introduction opening includes an elongated hole that extends along a part of the annular space and wherein the stop element has a length that is smaller than the length of the elongated hole of the introduction opening.

6. The auger arrangement according to claim 1, wherein on a front end the flexible steel cable has an introduction tip.

7. The auger arrangement according to claim 1, wherein the annular space has a circular cross sectional shape.

8. The auger arrangement according to claim 7, wherein the flexible steel cable has a circular cross sectional shape.

9. The auger arrangement according to claim 1, wherein the flexible steel cable has a circular cross sectional shape except the portion where the stop element is attached to.

* * * * *